US006974354B2

(12) United States Patent
Wu

(10) Patent No.: US 6,974,354 B2
(45) Date of Patent: Dec. 13, 2005

(54) BULB ASSEMBLY

(76) Inventor: Hsin-Wei Wu, No. 5, Lane 193, Kon Yean Road, Hsinchu City (TW)

( * ) Notice: Subject to any disclaimer, the term of this patent is extended or adjusted under 35 U.S.C. 154(b) by 4 days.

(21) Appl. No.: 10/833,167

(22) Filed: Apr. 28, 2004

(65) Prior Publication Data

US 2005/0245139 A1 Nov. 3, 2005

(51) Int. Cl.[7] ..... H01R 24/00; H01R 13/40; H01R 33/00

(52) U.S. Cl. ..... 439/699.2; 439/602; 362/226

(58) Field of Search ..... 439/699.2, 602, 439/356, 457, 574, 575, 336; 362/226

(56) References Cited

U.S. PATENT DOCUMENTS 5,647,761 A * 7/1997 Kaminski ..... 439/419
5,895,283 A * 4/1999 Takanashi ..... 439/336
6,036,522 A * 3/2000 Holzer ..... 439/306
6,053,774 A * 4/2000 Lin ..... 439/619
6,113,430 A * 9/2000 Wu ..... 439/619
6,361,368 B1 * 3/2002 Tseng ..... 439/619
6,464,539 B2 * 10/2002 Yoshida et al. ..... 439/619
6,514,105 B2 * 2/2003 Lin ..... 439/699.2
6,551,133 B2 * 4/2003 Tsukamoto et al. ..... 439/549
6,626,707 B2 * 9/2003 Henrici et al. ..... 439/699.2
6,648,691 B2 * 11/2003 Henrici et al. ..... 439/619

* cited by examiner

*Primary Examiner*—Chandrika Prasad
(74) *Attorney, Agent, or Firm*—Rosenberg, Klein & Lee

(57) ABSTRACT

The invention relates to a bulb assembly including a bulb holder and a socket, wherein the holder is provided with an elastic rod having an inclined bottom end. The socket is provided with a side slot having a bottom. The holder can insert into the socket and let the inclined end expose from the slot to engage both firmly. When the inclined end is pressed and moved inward, an upward force can be produced to push the holder moving upward a distance for separating from the socket in ease.

1 Claim, 4 Drawing Sheets

BULB ASSEMBLY

FIELD OF THE INVENTION

The present invention relates to a bulb assembly, which includes a bulb holder and a socket. The bulb holder can be easily engaged with the socket and separated from the same.

BACKGROUND OF THE INVENTION

A conventional bulb assembly is designed for firmly engaging the bulb holder with the socket, as shown in FIGS. 1 and 2. An extended rod (11) is formed on the holder (1) downward and a gap (21) is formed at bottom side of the socket (2). The rod (11) has an engaging end (111), which can engage with the gap (21) when the holder (1) inserts into the socket (2) to obtain a secure connection. When the bulb of this conventional bulb assembly is broken and must be replaced, referring to FIGS. 3 to 5, user must press the lower end of the extended rod (11) by his one hand and uses the other hand to pull out the holder (1) and the bulb. It is very inconvenient and difficult.

SUMMARY OF THE INVENTION

The present invention is to provide a new bulb assembly, wherein the bulb holder can connect with the socket firmly and can be separated from the same very easily. Now, accompanying with the following drawings, the character of the present invention will be described here and after.

DETAILED DESCRIPTION OF THE PREFERRED EMBODIMENT

Figure 1:
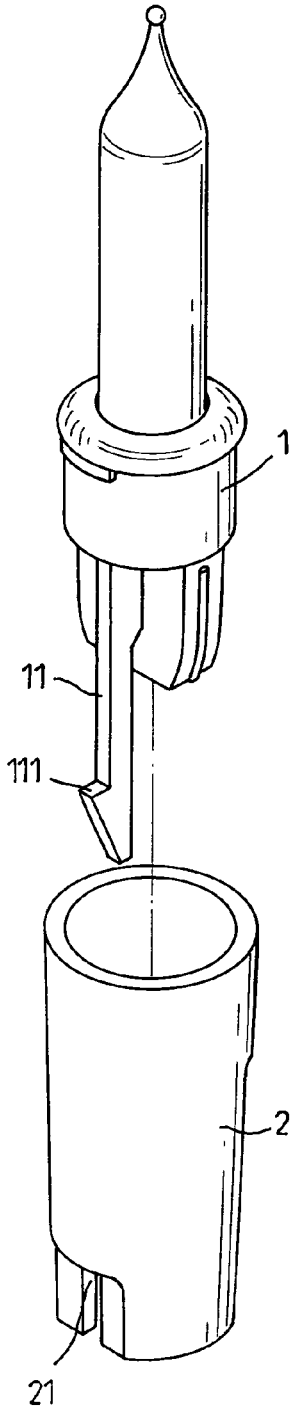
FIG. 1 (prior art)
FIG. 1 is an exploded perspective view showing a conventional bulb assembly.
Figure 2:
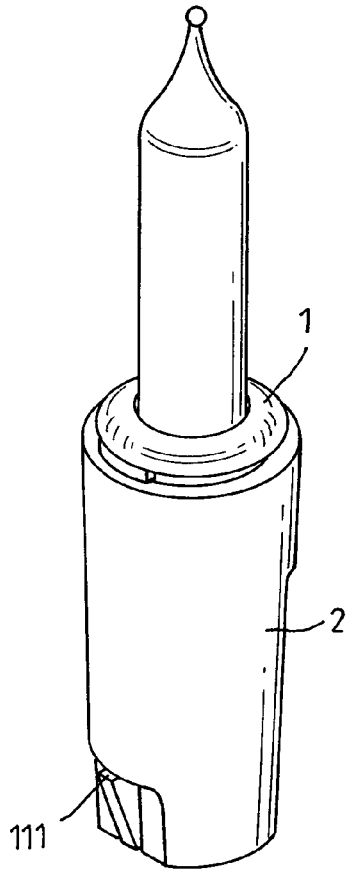
FIG. 2 (prior art)
FIG. 2 is an assembled perspective view of FIG. 1.
Figure 5:
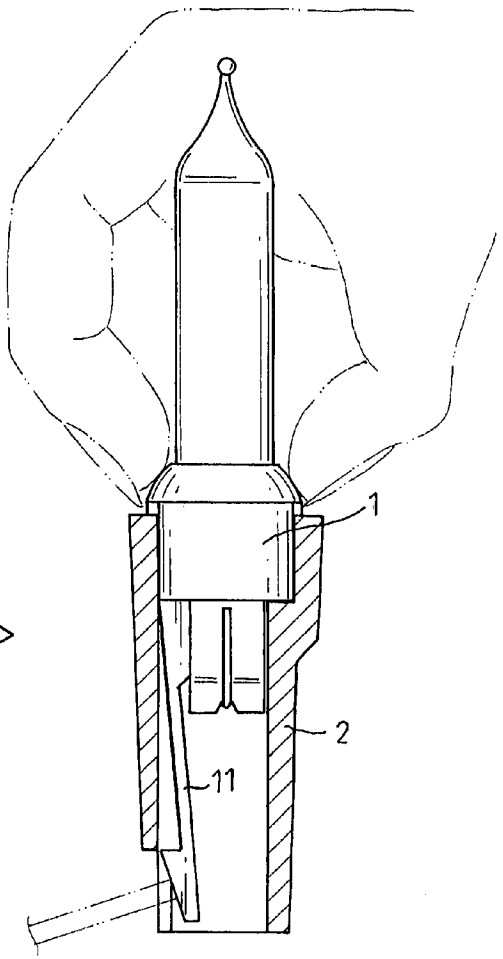
FIG. 5 (prior art)
FIGS. 4 and 5 are plan views showing the bulb holder being separated from the socket of the conventional bulb assembly.
Figure 4:
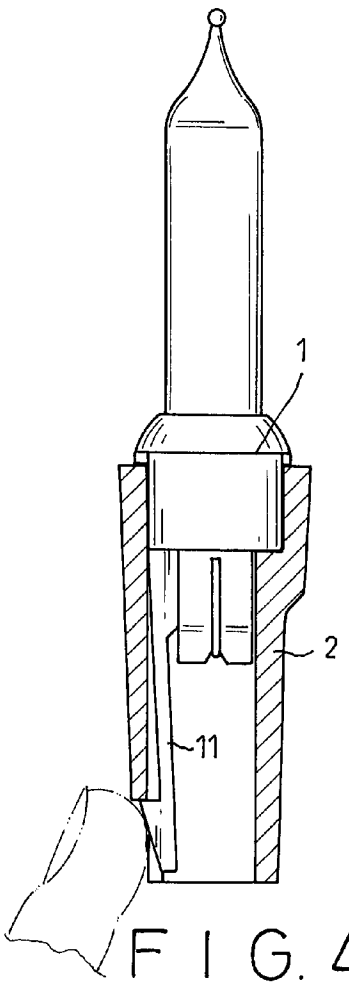
FIG. 4 (prior art)
Figure 3:
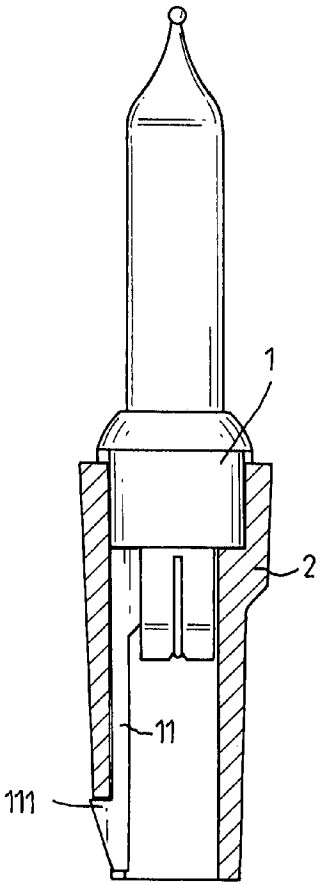
FIG. 3 (prior art)
FIG. 3 is a cross-sectional plan view of FIG. 2.
Figure 6:
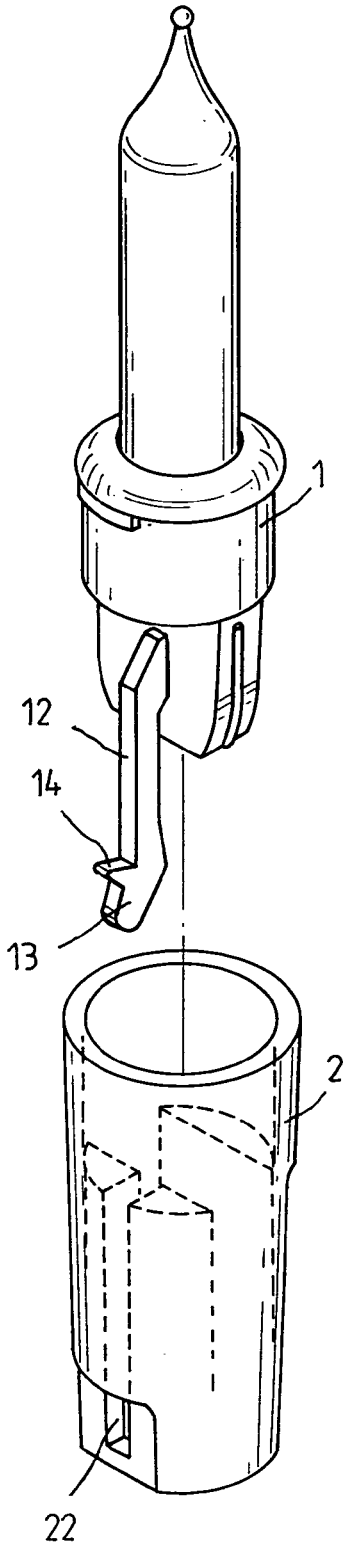
FIG. 6 is an exploded perspective view showing a bulb assembly according to the present invention.
Figure 7:
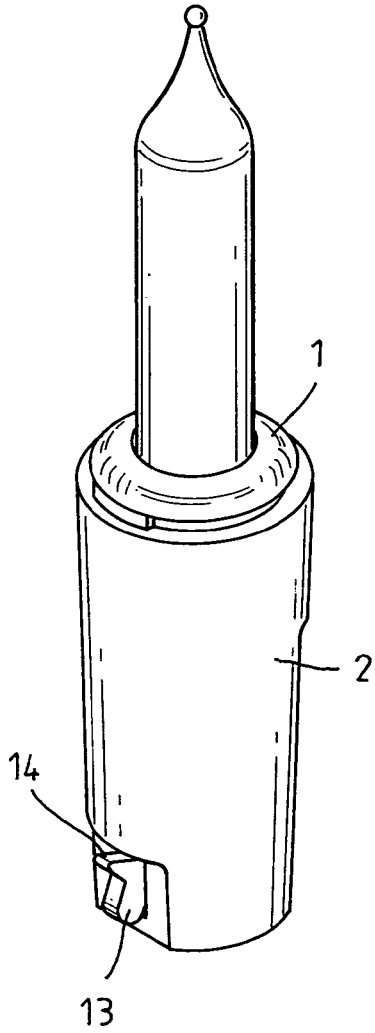
FIG. 7 is an assembled perspective view of FIG. 6.
Figure 8:
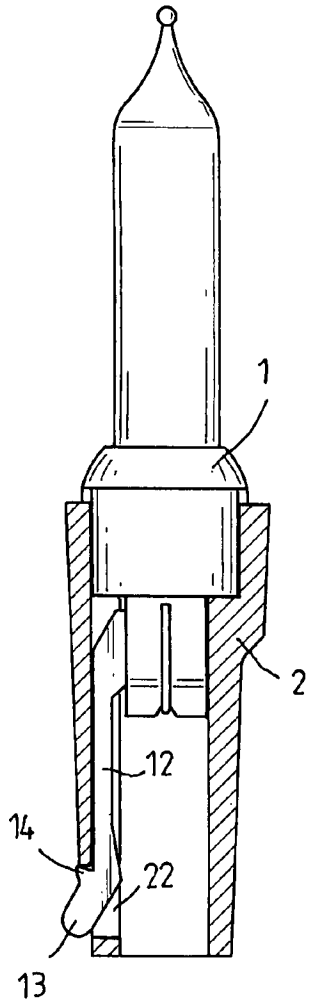
FIG. 8 is a cross-sectional plan view of FIG. 7.

Please referring to FIGS. 6 to 8, the present invention includes a bulb holder (1) and a socket (2). The holder is provided with an elastic rod (12), which has an outward hook (13) and inclined bottom end (14). The socket (2) is provided with a side slot (22) having a bottom (23).

When the holder (2) inserts into the socket (1), the elastic rod (12) extends downward and has the inclined end (14) exposed from the slot (22). At this moment, the hook (13) is engaged with top of the slot (22) that obtains a firm engagement between the holder (1) and the socket (2).

Figure 10:
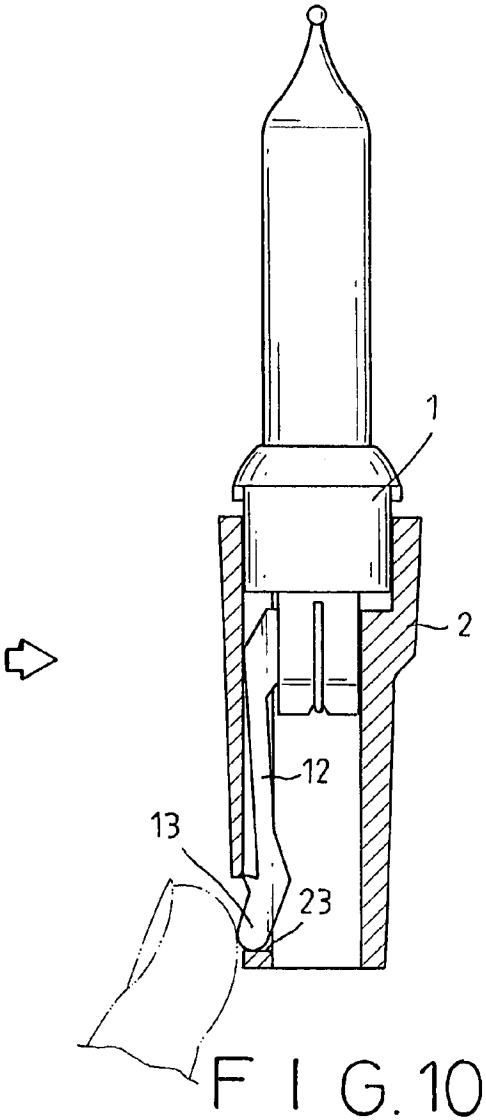
FIGS. 9 and 10 are plan views showing the bulb holder being separated from the socket according to the present invention.
Figure 9:
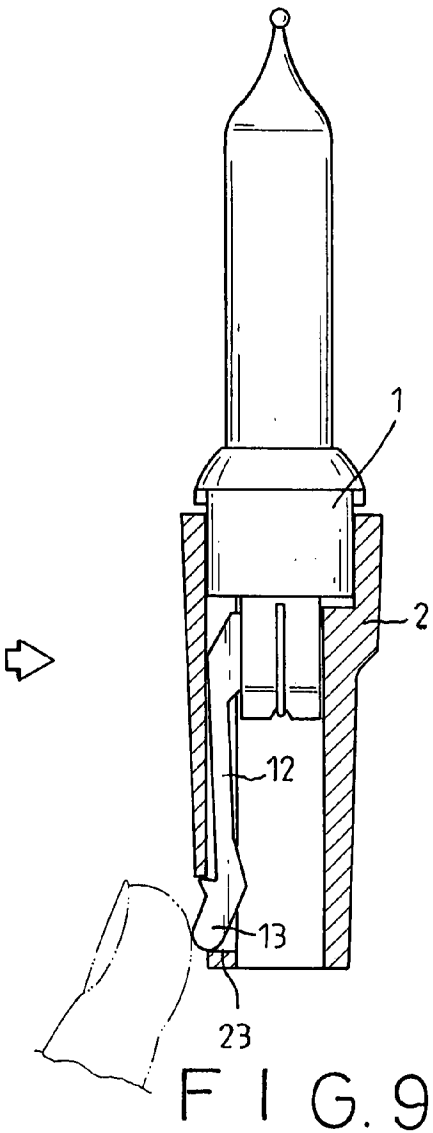

To separate the holder (2) from the socket (1), user can just press the inclined end (14), as shown in FIG. 9. When the inclined end (14) is pushed inward, the bottom end contacts with the bottom (23) of the slot (22) that produces an upward force. Hence, the elastic (12) and the holder (1) are moved upward a distance, as shown in FIG. 10. The holder (1) can be then separated from the socket (2) very easy at this state.

Accordingly, the bulb holder of the present invention can be engaged with the socket firmly and can be separated very easy. It is obviously utilized and effective.

I claim:

1. A bulb assembly including a bulb holder and a socket, wherein the holder is provided with an elastic rod, which has an inclined bottom end, and the socket is provided with a side slot having a bottom; the holder inserting into the socket to make the inclined end expose from the slot and the inclined end being capable of pressing and moving inward, and while the bottom end contacts with the bottom of the slot, an upward force is produced to push the holder moving upward a distance for separating from the socket.

* * * * *